United States Patent [19]

Miaskoff et al.

[11] Patent Number: 4,611,533

[45] Date of Patent: Sep. 16, 1986

[54] TYING APPARATUS

[75] Inventors: Leonard Miaskoff; Richard J. Merwarth, both of Plattsburgh, N.Y.

[73] Assignee: Harris Graphics Corporation, Melbourne, Fla.

[21] Appl. No.: 749,561

[22] Filed: Jun. 27, 1985

[51] Int. Cl.[4] ..... B65B 13/20

[52] U.S. Cl. ..... 100/7; 53/529; 53/589; 100/3; 100/26

[58] Field of Search ..... 100/3, 26, 8, 13, 27, 100/7; 53/439, 529, 530, 576, 589

[56] References Cited

U.S. PATENT DOCUMENTS

| | | | |
|---|---|---|---|
| 2,636,654 | 4/1953 | Sykes | 100/7 X |
| 3,114,308 | 12/1963 | Saxton | 100/7 X |
| 4,108,061 | 8/1978 | Bowser | 100/26 X |
| 4,397,229 | 8/1983 | Merwarth | 100/3 X |

FOREIGN PATENT DOCUMENTS

| | | | |
|---|---|---|---|
| 2739791 | 3/1979 | Fed. Rep. of Germany | 100/7 |

*Primary Examiner*—Billy J. Wilhite

*Attorney, Agent, or Firm*—Yount & Tarolli

[57] ABSTRACT

An improved tyer includes a central station where loose stacks of signatures sre received. A pair of tying stations are disposed on opposite sides of the central station. A pair receiving stations are disposed adjacent to the tying stations. An improved shuttle assembly is used to sequentially move loose stacks of sheets from the central station to one or the other of the tying stations. The shuttle assembly includes three pusher arms which are movable along tracks between the central and tying stations. Gaps are provided in the tracks at the tying station to enable bands or straps to be moved through the tracks and secured around loose stacks of signatures at the tying stations. In order to provide for as compact a loose stack of signatures as possible at a tying station, the loose stack of signatures is compressed between a pair of pusher arms as it is moved to a tying station. In order to protect the bottom of a tied stack of signatures, a cover sheet is positioned between the bottom of the loose stack of signatures and a support surface as the loose stack of signatures is moved from the central station to a tying station.

15 Claims, 11 Drawing Figures

TYING APPARATUS

BACKGROUND OF THE INVENTION

The present invention relates to an apparatus for tying loose stacks of signatures.

A stacker tyer for stacking signatures, such as newspapers, and tying loose stacks of signatures is disclosed in U.S. Pat. No. 4,397,229. The apparatus disclosed in this patent includes a shuttle assembly which alternately moves loose stacks of signatures to tying stations disposed on opposite sides of a central station. The shuttle assembly disclosed in this patent has a plurality of pusher arms which engage the loose stacks of signatures and push them to tying stations during operating strokes of the shuttle assembly in either direction from a central position. During return strokes of the shuttle assembly back to the central position, the pusher arms are retracted and are ineffective to move stacks of signatures.

SUMMARY OF THE INVENTION

An improved tyer has a shuttle assembly which is reciprocated to sequentially move loose stacks of signatures to tying stations disposed on opposite sides of a central station. The shuttle assembly has arms which push a loose stack of signatures toward one tying station during movement of the shuttle assembly in a first direction. The shuttle arms push a second loose stack of signatures toward the other tying station during movement of the shuttle assembly in the opposite direction. Thus, the shuttle assembly is effective to push loose stacks of signatures to one of the two tying stations during both forward and return strokes of the shuttle assembly.

In order to have a loose stack of signatures arrive at a tying station in as compact a stack as possible, the stack is compressed between pusher arms of the shuttle assembly as the signatures are moved to the tying station. When the stack is at the tying station, the loose stack is tied or bound by moving a band through gaps in tracks along which the shuttle assembly moves. During movement of a loose stack of signatures to a tying station, a sheet of paper is positioned between the bottom of the stack and the support surface along which the stack moves.

Accordingly, it is an object of this invention to provide a new and improved apparatus for tying loose stacks of signatures and wherein the apparatus includes a shuttle assembly which is effective to move loose stacks of signatures to tying stations during both forward and return strokes of the shuttle assembly.

Another object of this invention is to provide a new and improved apparatus for tying loose stacks of signatures and wherein the loose stacks of signatures are compressed between pusher arms of a shuttle assembly during movement to a tying station.

Another object of this invention is to provide a new and improved apparatus for sequentially tying loose stacks of signatures and wherein a shuttle assembly moves a loose stack of signatures to a tying station where a band moves through a gap in a shuttle guide track and is wrapped tightly around the stack of signatures.

Another object of this invention is to provide a new and improved apparatus for sequentially tying loose stacks of signatures and wherein a sheet is positioned between a support surface and the bottom of the loose stack of signatures before it is tied.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
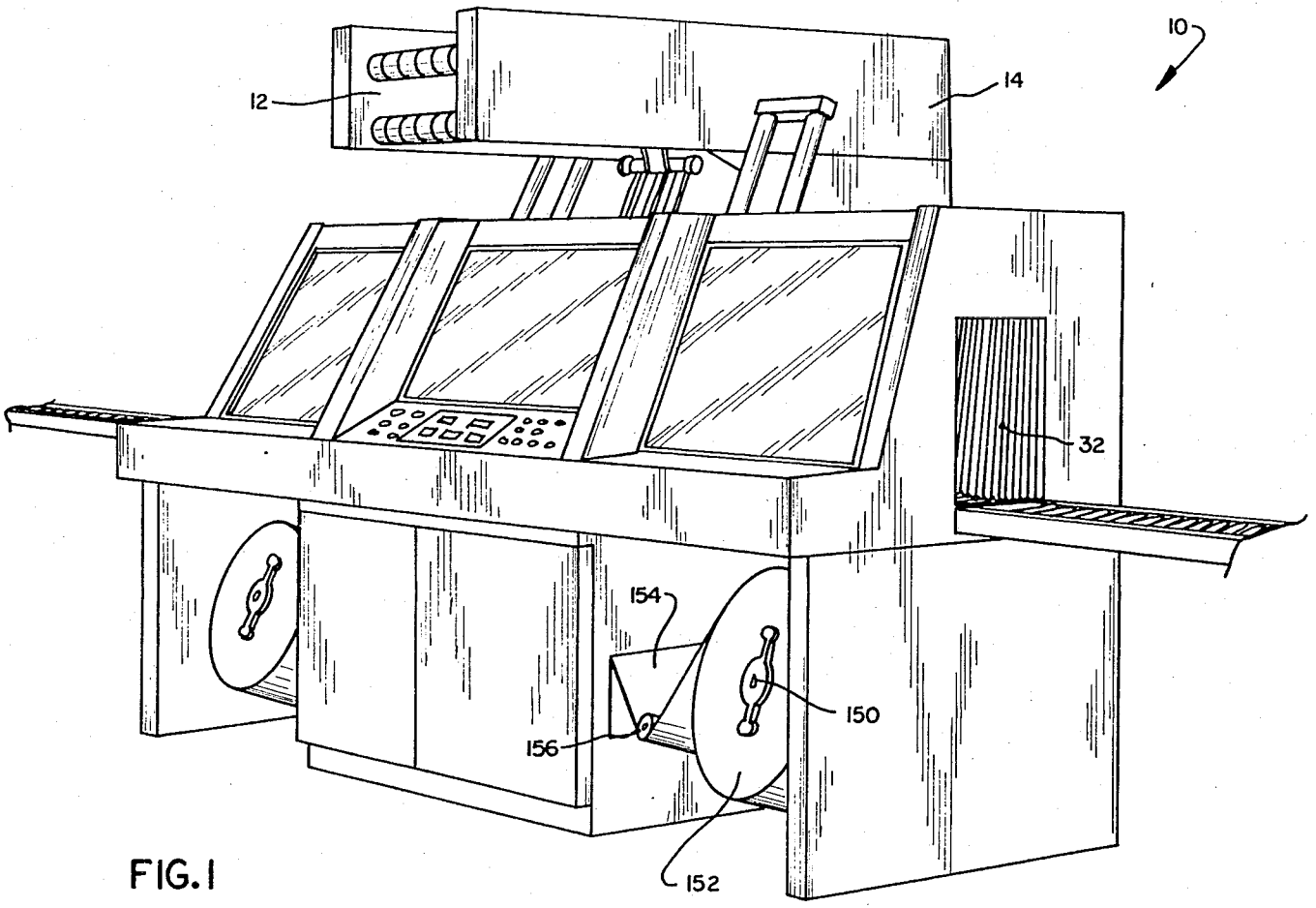
FIG. 1 is a pictorial illustration of an apparatus for sequentially tying loose stacks of signatures.

An apparatus 10 for sequentially tying loose stacks of signatures is illustrated in FIG. 1. The apparatus 10 includes an inlet conveyor 12 which receives signatures, such as newspapers, in a lapped stream. The lapped stream of newspapers is formed into a loose stack by a stacker mechanism 14. The loose stack 16 of newspapers (FIG. 2) is deposited by the stacker 14 at a central station 18 in the apparatus 10. The manner in which the stacker 14 forms the lapped stream of newspapers into a loose stack and deposits them at the central station 18 is the same as is disclosed in U.S. Pat. No. 4,397,229.

An improved shuttle assembly 22 (FIG. 2) sequentially moves loose stacks 16 of newspapers from the central station 18 to either a right tying station 24 or a left tying station 26. The loose stacks of newspapers are bound or tied at the tying stations 24 and 26 by tying or strapping machines 28 and 30. The bound or tied stacks 16 of newspapers are then delivered to receiving stations 32 and 34. At the receiving stations 32 and 34, the tied stacks 16 of newspapers are supported on and move along downwardly sloping roller conveyors 36 and 38 to handling stations outside of the apparatus 10.

Shuttle Assembly

Figure 3:
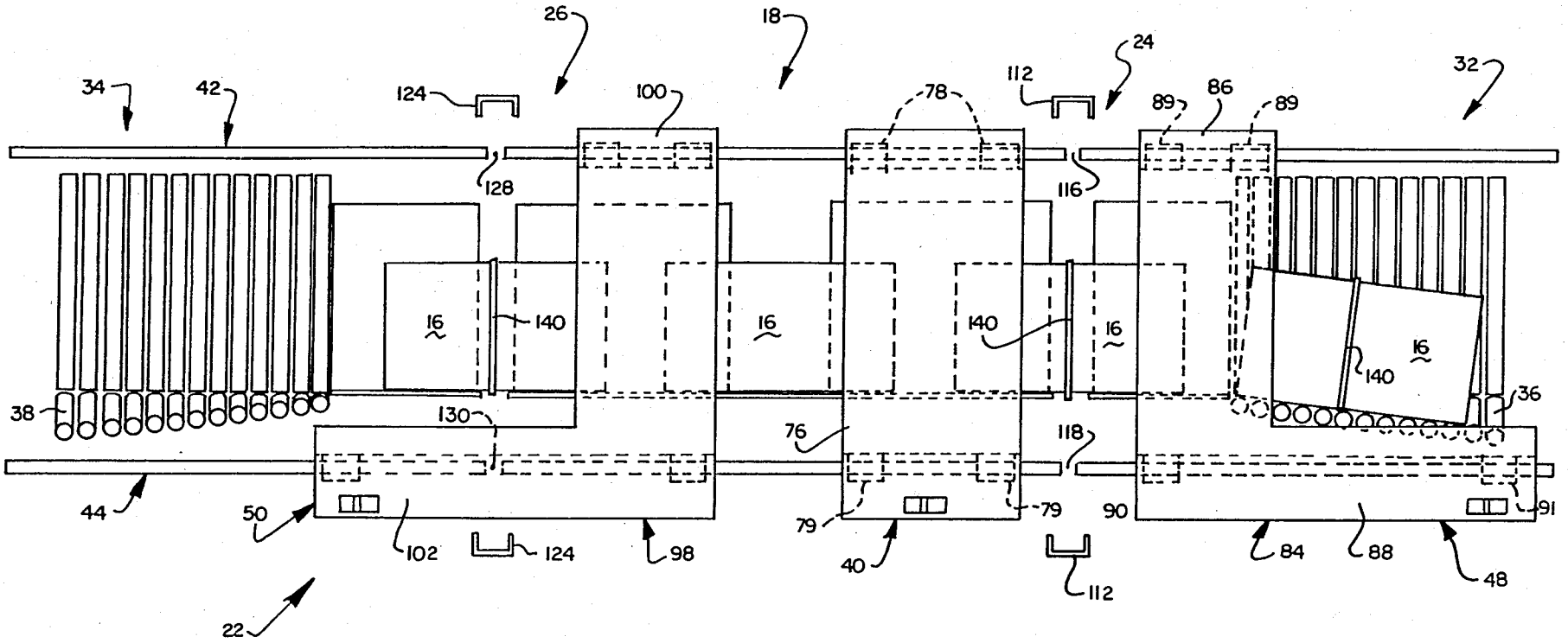
FIG. 3 is a schematic illustration, taken generally along the line 3—3 of FIG. 2, depicting the manner in which pusher arms in the shuttle assembly are supported on a pair of tracks.

The shuttle assembly 22 sequentially pushes the loose stacks 16 of newspapers from the central station 18 to the tying stations 24 and 26 and receiving stations 32 and 34. The shuttle assembly 22 includes a center pusher arm 40 which is slidable along upper and lower guide tracks 42 and 44 (FIG. 3). The guide tracks 42 and 44 extend from the right receiving station 32 through the tying station 24, central station 18 and tying station 26 to the left receiving station 34.

Figure 2:
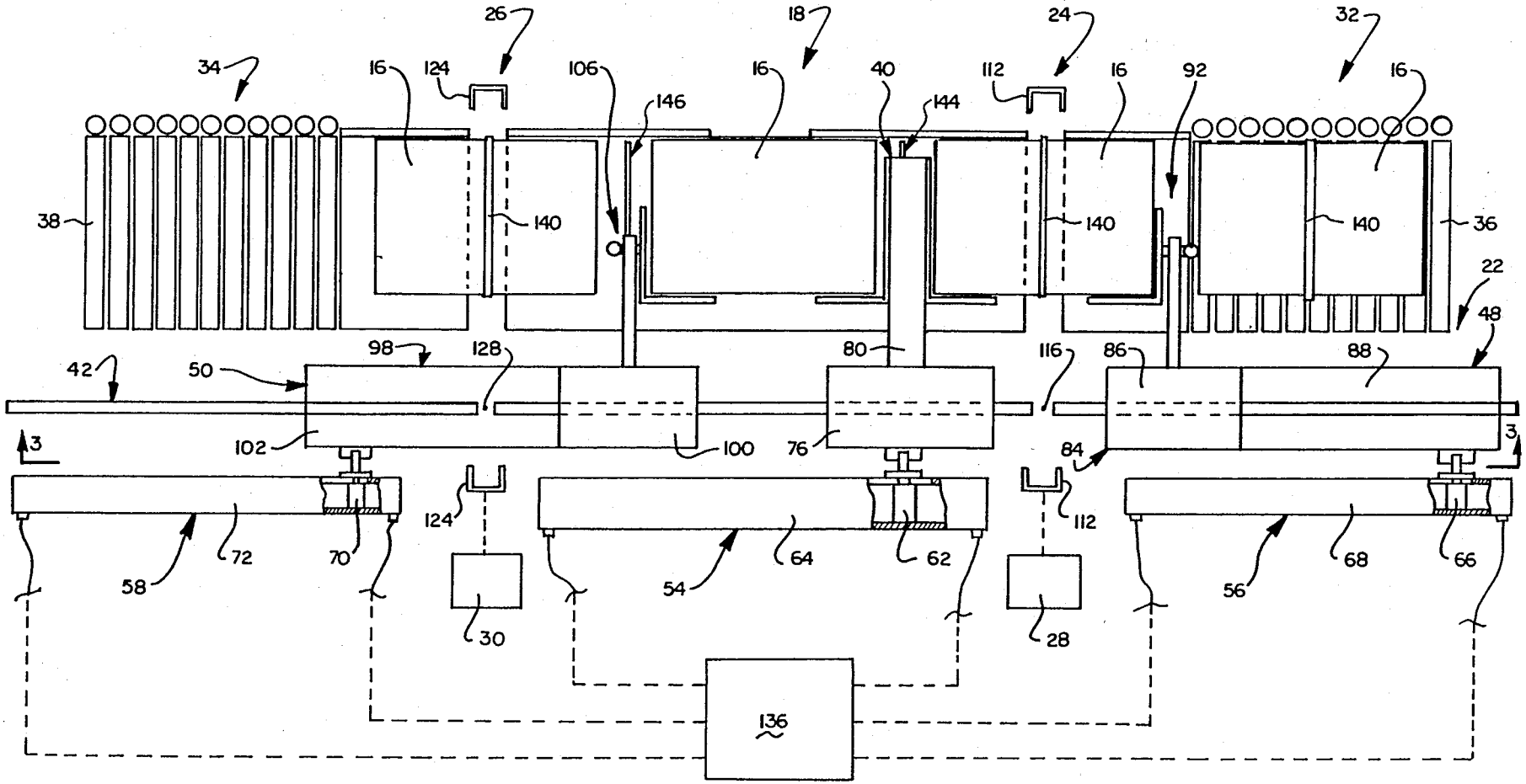
FIG. 2 is a schematic illustration depicting the construction of a shuttle assembly which sequentially pushes stacks of signatures from a central station to either one of a pair of tying stations disposed on opposite sides of the central station.

In addition to the center pusher arm 40, the shuttle assembly 22 includes left and right pusher arms 48 and 50. The pusher arms 48 and 50 are also movable along the guide tracks 42 and 44. The center pusher arm 40 is reciprocated back and forth to opposite sides of the central station 18 by a linear fluid motor 54 (FIG. 2). Similarly, the pusher arms 48 and 50 are reciprocated back and forth by linear motors 56 and 58.

The motor 54 has a piston 62 which is fixedly connected to the pusher arm 40 and is movable axially along a cylinder 64. Similarly, the motor 56 has a piston 66 which is connected with the pusher arm 48 and is movable axially along a cylinder 68. The motor 58 has a piston 70 which is movable axially along a cylinder 72. Although the motors 54, 56 and 58 may have many different constructions, it it is preferred to use the relatively compact rodless air cylinder-type motors which may be obtained from Origa Corporation of 928 N. Oaklawn Ave., Elmhurst, Ill., U.S.A.

The center pusher arm 40 includes a base section 76 (FIG. 3) which extends between the upper and lower guide tracks 42 and 44. The upper end portion of the base section 76 has a pair of elongated generally U-shaped channels 78 which slidably engage the upper guide track 42. Similarly, the lower portion of the base section 76 has a pair of elongated channels 79 having a generally U-shaped cross sectional configuration which engage the lower guide track 44.

An arm section 80 (FIG. 2) of the center pusher arm 40 extends outwardly from the base section 76 in a direction perpendicular to the parallel central axes of the guide tracks 42 and 44. The arm section 80 is fixedly connected to the base section 76. Therefore, the arm section 80 cannot be retracted and is effective to push a loose stack 16 of newspapers toward either the left or right each time the pusher arm 40 is moved through an operating stroke by the motor 54. The base section 76 is connected to the piston 62 in the motor 54.

The right (as viewed in FIGS. 2 and 3) pusher arm 48 has a base section 84 (FIG. 3) which is connected with the guide tracks 42 and 44. The base section 84 includes an upright main section 86 which extends vertically between the horizontal guide tracks 42 and 44. An elongated connector section 88 extends rightwardly from the main section 86 and is connected with the piston 66 (FIG. 2) of the motor 56.

Movement of the base section 84 along the upper guide track 42 (FIG. 3) is guided by a pair of elongated channels 89 having a generally U-shaped cross sectional configuration and connected with the main section 86 of the base. Similarly, movement of the base 84 along the lower guide track 44 is guided by an elongated channel 90 which is connected with the main section 86 of the base and a second elongated channel 91 which is connected with the connector section 88.

Figure 9:
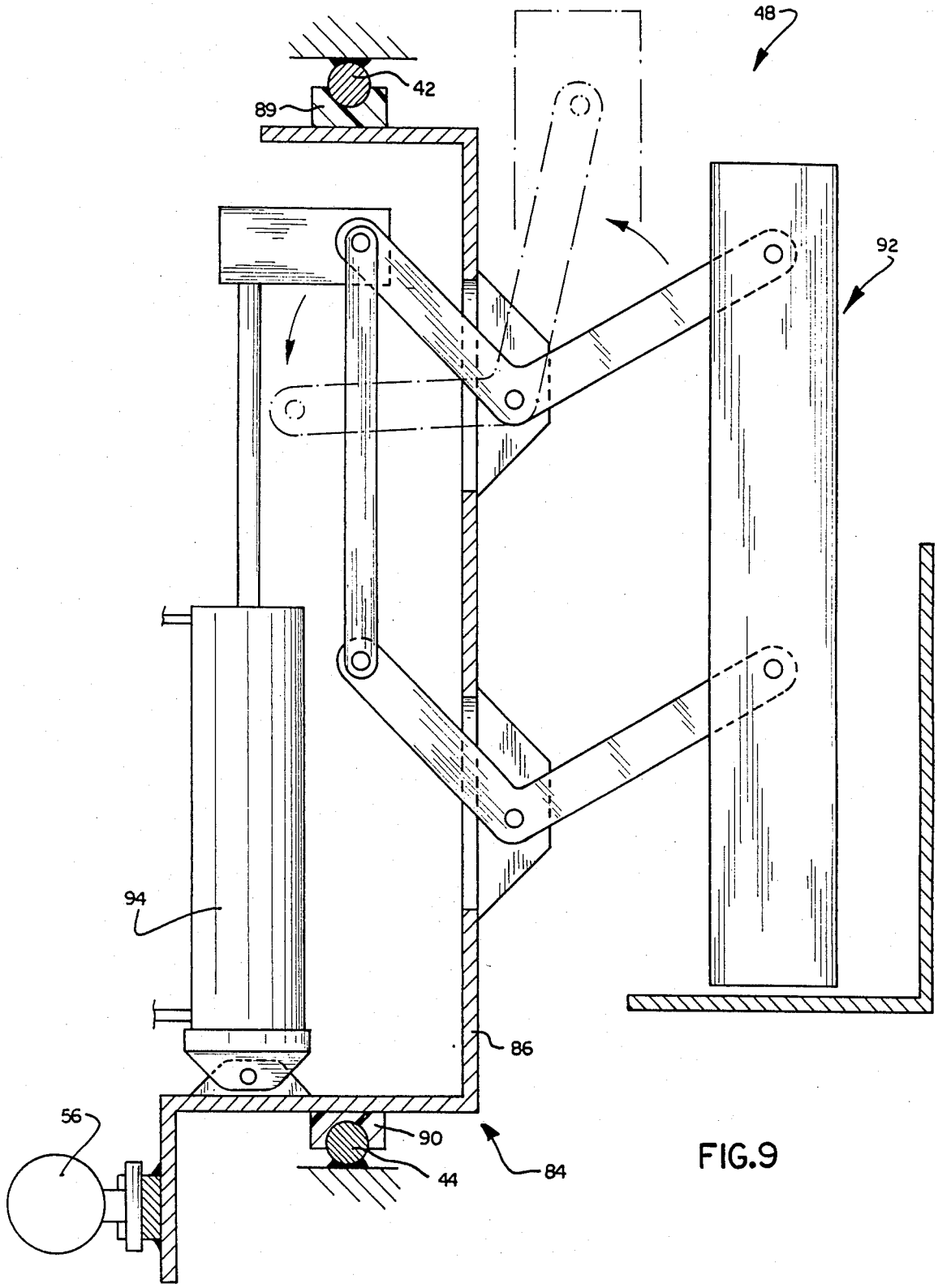
FIG. 9 is a fragmentary sectional view illustrating the construction of a pusher arm in the shuttle assembly.

The right pusher arm 48 has an arm section 92 (FIG. 2) is pivotally connected to the base for movement by a piston and cylinder type motor 94 (FIG. 9) between an extended condition shown in solid lines in FIG. 9 and a retracted condition shown in dashed lines in FIG. 9. This enables the right pusher arm 48 to move a tie stack of newspapers from the tying station 24 to the receiving station 32 and then to be retracted during subsequent leftward movement of the pusher arm 48. Therefore, a stack of newspapers at the tying station 24 is not moved leftwardly by return movement of the pusher arm 48.

The left pusher arm 50 has the same general construction as the right pusher arm 48. However, the left pusher arm is inversely oriented or is a mirror image of the right pusher arm 48. Thus, the left pusher arm 50 has a base 98 (FIG. 3) with an upper or main section 100 which extends between the upper and lower guide tracks 42 and 44. In addition, the base 98 has a connector section 102 which is connected with the piston 70 (FIG. 2) in the motor 58. A retractable arm section 106 is connected with the base section 98 and has the same construction as the arm section 92. Thus, the arm section 106 is movable by a piston and cylinder type motor (not shown) between a retracted condition and an extended condition in which the arm 106 extends outwardly from the base section 98.

Tying Machines

The tying machine 28 (FIG. 2) at the right tying station 24 ties bands or straps around loose stacks of newspapers at the tying station. The tying machine 28 includes a strap feed mechanism which moves a strap or band along a chute 112 which extends around the tying station 24. The chute 112 is formed by a generally U-shaped track. The chute 112 has a rectangular configuration and opens inwardly toward the center of the space enclosed by the chute. Thus, the chute 112 extends completely around the tying station 24 and the tracks 42 and 44.

In order to enable a strap or band to be pulled tightly against a loose stack of newspapers at the tying station 24, a gap 116 is provided in the upper track 42 (FIGS. 2 and 3). The gap 116 is in line with the chute 112 and the center of the right tying station 24. A gap 118 (FIG. 3) is provided in the lower track 44 in line with the chute 112 and the center of the tying station 24.

Once a strap or band 140 has been fed around the chute 112 so that it circumscribes the tying station 24, the strap is pulled through the gaps 116 and 118 in the upper and lower tracks 42 and 44. After the strap 140 has been tightened around the loose stack 16 of newspapers, the strap is welded to interconnect the ends of the strap. Although the tying machine 28 could have many different constructions, in one embodiment of the invention the tying machine was a Series MCD-710 Automatic Power Strapping Machine obtained from Signode Corporation of 2600 N. Western Ave., Chicago, Ill., U.S.A.

To avoid interference with the shuttle assembly 22, the chute 112 is positioned outwardly of the path of movement of the pusher arm 48 (FIGS. 2 and 3). Thus, when the pusher arm 48 is moved leftwardly from the position shown in FIG. 2, the connector section 88 moves across the gaps 116 and 118 (FIG. 3) without interferring with the chute 112 (see FIG. 4). If the chute 112 was disposed between the tracks 42 and 44 and the loose stack 16 of newspapers at the tying station 24, the pusher arm 48 would interfere with the chute 112. By making the chute 112 large enough to circumscribe the path of movement of the pusher arm 48, interference between the pusher arm 48 and the chute 112 is avoided by having the pusher arm move through the rectangular space circumscribed by the chute.

The tying machine 30 at the tying station 26 has the same construction as the tying machine 28 at the tying station 24. The tying machine 30 includes a chute 124 which extends around the upper and lower tracks 42 and 44 and is disposed outwardly of the path of movement of the pusher arm 50 (FIG. 2). Upon operation of the tying mechanism 30, a band or strap is moved through gaps 128 and 130 in the tracks 42 and 44 (FIG. 3) and is tied tightly around a loose stack of signatures at the tying station 26.

Operation

Upon initiation of operation of the apparatus 10, a first loose stack **16*a* (FIG. 4) of signatures, that is, newspapers, arrives at the central station 18. Assuming that the shuttle assembly 22 is in the position shown in FIG. 4, the first loose stack 16*a* of newspapers is positioned between the center and right pusher arms 40 and 48. The motors 54, 56 and 58 are then operated to simultaneously move the pusher arms 40, 48 and 50 rightwardly from the position shown in FIG. 4 to the position shown in FIG. 5. This moves the loose stack 16*a* of newspapers from the central staion 18 to the right tying station 24**.

Figure 4:
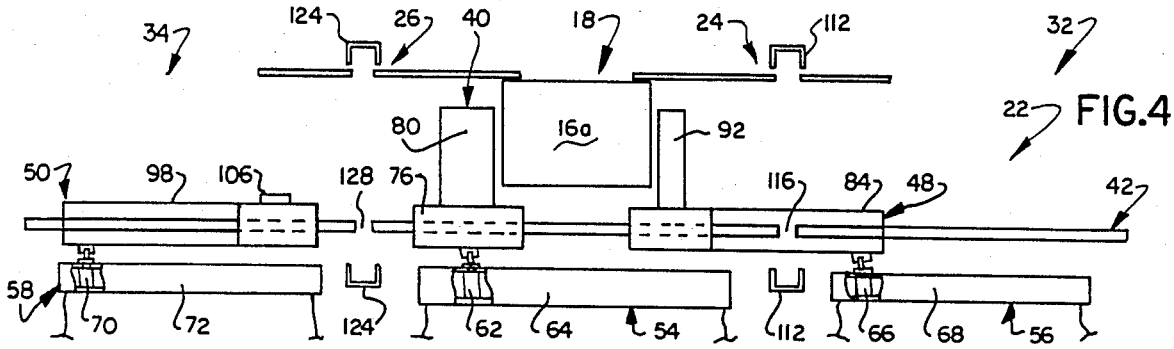
FIG. 4 is a schematic illustration depicting the manner in which a loose stack of signatures is received at a central station.
Figure 5:
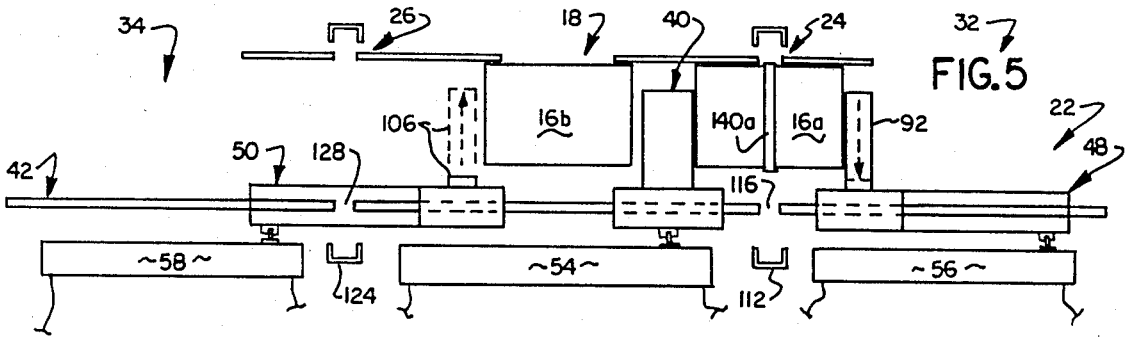
FIG. 5 is a schematic illustration depicting the manner in which the loose stack of signatures of FIG. 4 is moved from the central station to a tying station disposed on the right side of the central station during an operating stroke of the shuttle assembly in one direction.

During movement of the loose stack **16*a* of newspapers toward the tying station 24, a control apparatus 136 (see FIG. 2) causes air to be delivered to the central motor 54 at a slightly higher flow rate than to the right motor 56. This results in the pusher arm 40 moving toward the pusher arm 48. As the distance between the pusher arms 40 and 48 decreases, the loose stack 16*a* of newspapers is compressed between the outwardly projecting arm sections 80 and 92 (FIGS. 4 and 5). Therefore, when the loose stack 16*a* of newspapers reaches the tying station 24**, the stack has been compressed in preparation for tying.

While the loose stack **16*a* of newspapers is at the tying station 24 (FIG. 5), a band or strap 140 moves from the chute 112 of the right tying mechine 28 through the gaps 116 and 118 (FIG. 3) in the upper and lower track 42 and 44. The strap is then tightened and tied around the loose stack 16*a* of newspapers. While the strap 140 is being tied around the loose stack 16*a* of newspapers, the right pusher arm 48 remains to the right of the gaps 116 and 118 (FIG. 5) so that the band 140** can move through the gaps without interference.

The arm section 92 of the right pusher arm 48 is retracted while the pusher arm 48 remains in the position shown in FIG. 5. Contemporaneously with the retracting of the arm section 92 of the right pusher arm 48, the arm section 106 of the left pusher arm 50 is extended in the manner shown in dashed lines in FIG. 5. By this time, a second loose stack **16*b* of newspapers has arrived at the central station 18**.

Figure 6:
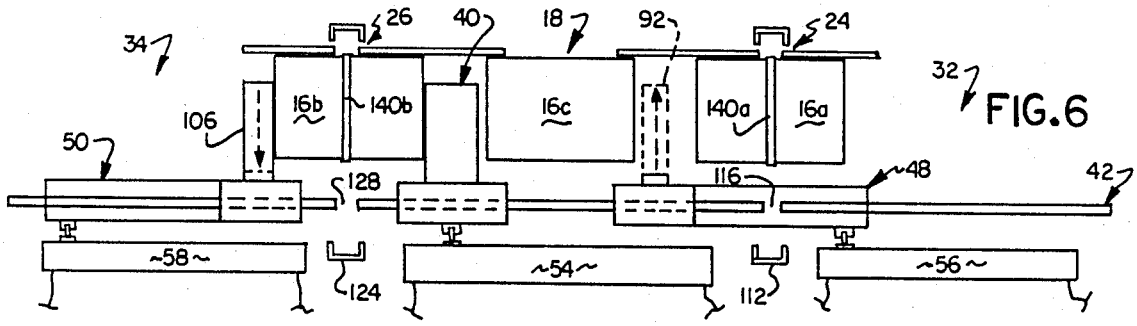
FIG. 6 is a schematic illustration depicting the manner in which a second stack of loose signatures is moved from the central station to a tying station disposed on the left side of the central station during a return stroke of the shuttle assembly.

Shuttle drive motors 54, 56 and 58 are then activated to move the second stack **16*b* of newspapers from the central station 18 (FIG. 5) to the left tying station 26 (FIG. 6). As the second loose stack 16*b* of newspapers is being moved to the left tying station 26, the central pusher arm 40 moves toward the left pusher arm 50 to compress the stack 16*b*** of newspapers between the two pusher arms.

The precompressed stack **16*b* of newspapers is tied at the left tying station 26. To accomplish this, the left tying machine 30 moves a strap 140*b* along the chute 124 until the strap completely circumscribes the loose stack 16*b* of newspapers. The tying mechanine 30 then moves the band 140*b* through the gaps 128 and 130 (FIG. 3) in the upper and lower tracks 42 and 44 and tightens the band around the loose stack 16*b* of newspapers. The band 140*b* is then welded to tightly bundle the stack 16*b*** of newspapers.

While the tying of the stack **16*b* of newspapers is occurring, the left pusher arm 50 remains leftwardly of the gaps 128 and 130 (FIGS. 3 and 6). Therefore, there is no interference with movement of a band 140*b* through the gap 128 and 130*s*. It should be noted that at this time the right pusher arm 48 is blocking the gap 118 in the lower track 44 (FIGS. 3 and 6**).

Figure 7:
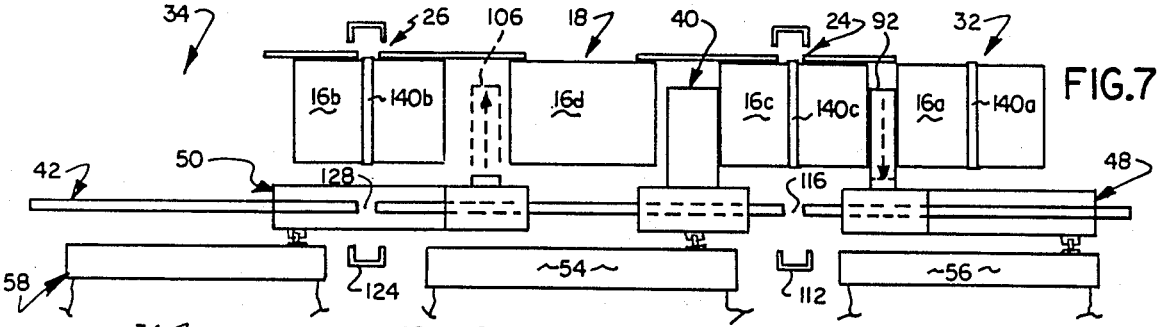
FIG. 7 is a schematic illustration depicting the manner in which a bound or tied stack of signatures is moved from the right tying station to a receiving station as a succeeding loose stack of signatures is moved to the right tying station by the shuttle assembly.

After the arm section 106 of the left pusher arm 50 has been retracted in the manner indicated in dashed lines in FIG. 6 and the arm section 92 of the right pusher arm 48 has been extended, the shuttle assembly 20 is operated to move a third loose stack **16*c* of newspapers from the central station 18 to the right tying station 24. As the loose stack 16*c* of newspapers is being moved to the right tying station 24, the central pusher arm 40 moves toward the right pusher arm 48 to precompress the stack 16 in the manner previously explained. As the loose stack 16*c* of newspapers is being pushed to the right tying station 24, the previously tied stack 16*a* of newspapers is pushed from the right tying station 24 to the right receiving station 32 (see FIG. 7). Once the tied stack 16*a* of newspapere reaches the receiving station 32, it immediately begins to move along the downwardly sloping roller conveyor 36 (FIG. 3**).

Figure 8:
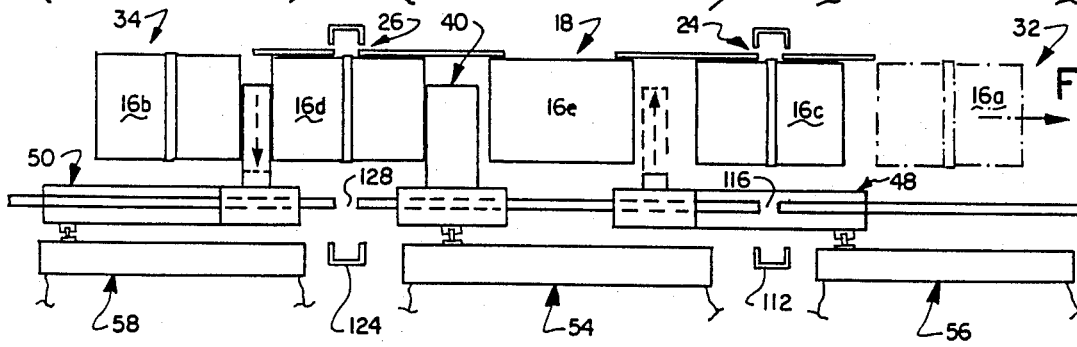
FIG. 8 is a schematic illustration depicting the manner in which a tied stack of signatures is moved from the left tying station to a receiving station as a succeeding loose stack of signatures is moved to the left tying station.

As the stack **16*c* of newspapers has been tied, the arm section 92 of the right pusher arm 48 is retracted, and the arm section 106 of the left pusher arm 50 is extended. The shuttle assembly 22 is then operated to move a next succeeding loos stack 16*d* of newspapers from the central station 18 to the left tying station 26 (FIG. 8). At the same time, the tied stack 16*b* of newspapers is moved from the left tying station 26 to the left receiving station 34 (see FIG. 8**).

Upon arrival of a tied stack of newspapers at either the right receiving station 32 of the left receiving station 34, the stack of newspapers is automatically conducted from the tying apparatus 10. Thus, at the receiving stations 32 and 34 the tied stacks **16*a* and 16*b* of newspapers are disposed on the downwardly sloping roller conveyors 36 and 38 (FIG. 3). This results in the stack 16*a* of tied newspapers leaving the right receiving station 32, in the manner indicated by the arrow in FIG. 8, before tied stack 16*b* of newspapers arrives at the left receiving station 34**.

Bottom Sheet

It is contemplated that it may be desirable to protect the tied stacks 16 of newspapers with bottom sheets of paper disposed between the bands 140 and the bottom of the stacks of newspapers. To this end, a paper feed mechanism 142 (FIG. 10) is provided at a paper feed station 144. The paper feed station 144 is disposed midway between the central station 18 and right tying station 24. A similar paper feed mechanism is disposed at a paper feed station 146 disposed midway between the central station 18 and the left tying station 26 (FIG. 2).

The paper feed mechanism 142 includes a support shaft 150 upon which a roll 152 of paper is supported. A web 154 from the roll 152 extends around a dancer roll 156 and an idler roll 158 to a drive roll 160. The drive roll 160 is driven by an electric motor 162 through a chain drive 164. A spring loaded pinch roller 166 presses the web 154 against the drive roll 160. A knife assembly 170 is operable to cut a sheet 172 of paper of a predetermined length from the web 154.

A control assembly 180 regulates the operation of the motor 162 and knife assembly 170. The knife assembly 170 is operated to cut the web 154 when an end portion 184 paper projects above a support surface 186. Loose stacks 16 of newspapers are moved from the central station 18 to the right tying station 24 along the support surface 186.

Figure 11:
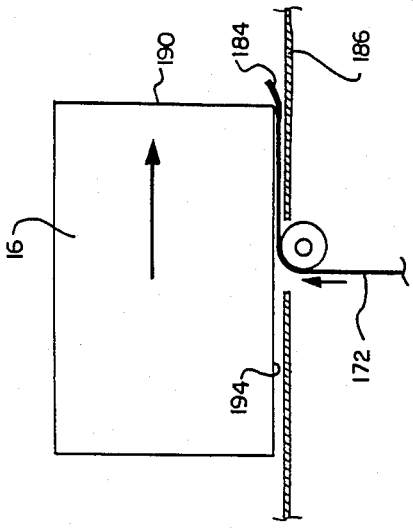
FIG. 11 is a schematic illustration depicting the manner in which a sheet of paper is pulled onto the support surface at the paper feed station by engagement with a stack of signatures.
Figure 10:
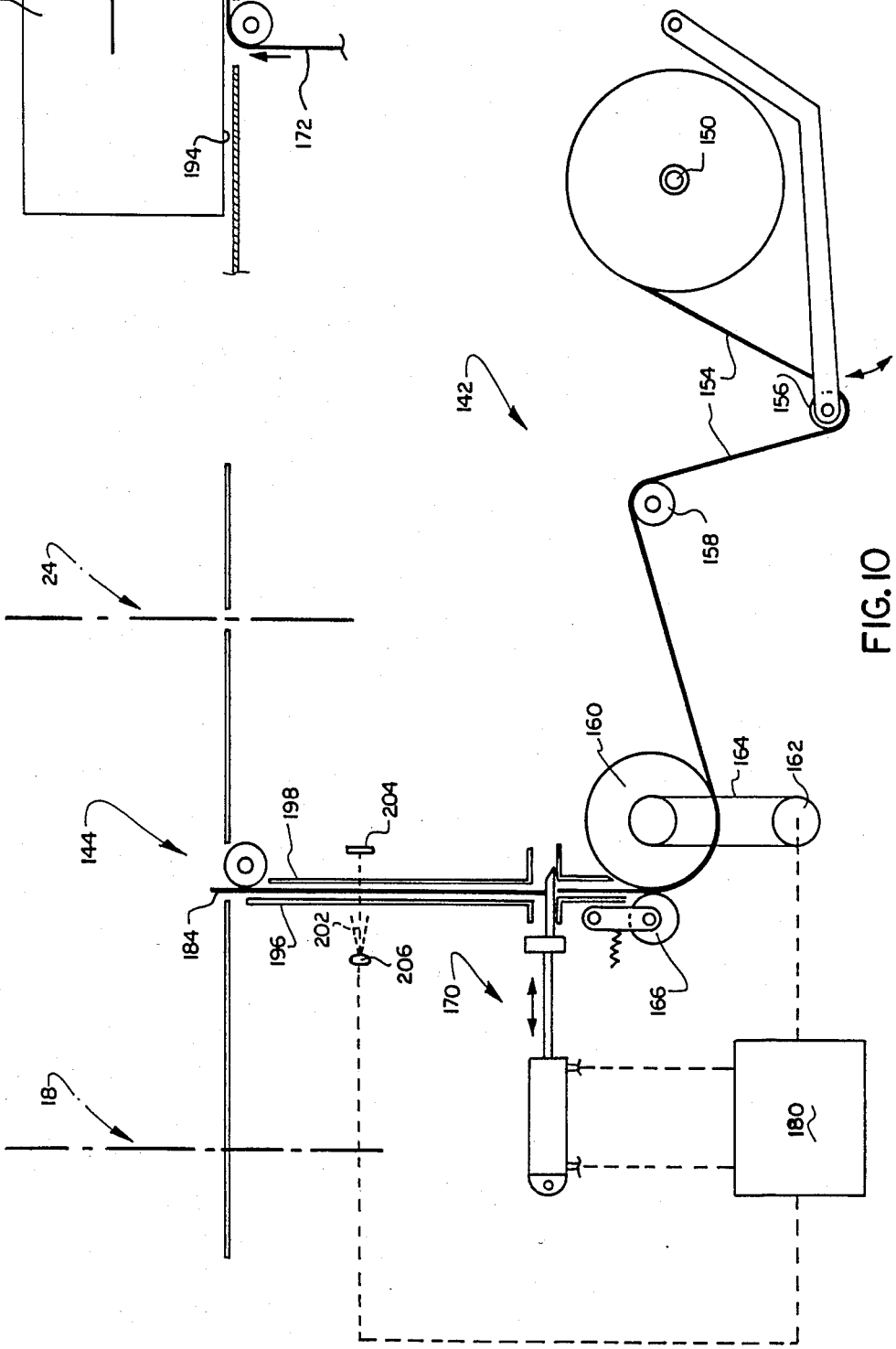
FIG. 10 is a schematic illustration depicting the manner in which an end of a sheet extends above a support surface at a paper feed station disposed between the central station and the right tying station.

When a loose stack 16 of newspapers (FIG. 11) is being pushed toward the tying station 24 by the pusher arm 40, the leading end portion 190 of the stack comes into engagement with the end portion 184 of the sheet 172. Continued movement of the loose stack 16 of newspapers causes the sheet 172 to be gripped between the support surface 186 and the bottom 194 of the stack of newspapers. Continued movement of the stack 16 of newspapers toward the right tying station 24 results in the sheet 172 being pulled out of a pair of guides 196 and 198 (FIG. 10). When the trailing end of the sheet 172 moves past a beam 202 of light from a light source 204, a photocell 206 signals the control apparatus 180 to have a next succeeding length of the web 154 fed from the roll 152.

When the loose stack 16 of newspapers arrives at the tying station 24, the sheet 172 of paper will be the tying station and be disposed beneath the stack of newspapers. Therefore, when the band 140 is tied around the stack 16 of newspapers, the sheet 172 will be located between the band and the bottom of the stack to protect the bottom of the stack during subsequent handling.

Conclusion

An improved apparatus 10 for tying stacks of newspapers or signatures has a shuttle assembly 22 which is reciprocated to sequentially move loose stacks 16 of newspapers to tying stations 24 and 26 disposed on opposite sides of a central station 18. The shuttle assembly 22 has a pusher arm 40 which pushes a loose stack 16 of newspapers toward a right tying station 24 during movement of the shuttle assembly in a rightward direction (as viewed in FIG. 4). The pusher arm 40 pushes a loose stack 16 of newspapers toward the left tying station 26 during movement of the shuttle assembly 22 in the opposite direction. Thus, the shuttle assembly 22 is effective to push loose stacks 16 of newspapers to one of the two tying stations 24 or 26 during both left and right strokes of the shuttle assembly.

In order to have the newspapers arrive at a tying station 24 or 26 in as compact a stack as possible, the stacks of newspapers are compressed between pusher arms of the shuttle assembly as the newspapers are moved to a tying station 24 or 26. When a stack of newspapers is at a tying station, the stack is tied or bound by moving a band 140 through gaps in the tracks 42 and 44 along which the shuttle assembly 22 moves. During movement of a loose stack 16 of newspapers to a tying station 24 or 26, a sheet 172 of paper is inserted between the bottom 194 of the stack and the support surface 186 along which the stack moves.

Although the foregoing description has been related to stacks 16 of newspapers, the invention could be practiced with other types of signatures.

Having described a specific preferred embodiment of the invention, the following is claimed:

1. An apparatus for sequentially tying loose stacks of signatures, said apparatus comprising a central station, a first tying station disposed adjacent a first side of said central station, a second tying station disposed adjacent a second side of said central station, a first receiving station disposed adjacent to a side of said first tying station opposite from said central station, a second receiving station disposed adjacent to a side of said second tying station opposite from said central station, track means extending from said first receiving station through said first tying station, central station and second tying station to said second receiving station, said track means including first surface means for defining a first gap in said track means at said first tying station and second surface means for defining a second gap in said track means at said second tying station, shuttle means for sequentially pushing stacks of signatures from said central station to said tying and receiving stations, drive means for reciprocating said shuttle means along said track means, said drive means being operable to move said shuttle means in a first direction to move a loose stack of signatures to said first tying station and to move a tied stack of signatures to said first receiving station, said drive means being operable to move said shuttle means in a second direction to move a loose stack of signatures to said second tying station and to move a tied stack of signatures to said second receiving station, first tying means at said first tying station for sequentially moving bands though said first gap in said track means and tying the bands around loose stacks of signatures at said first tying station, and second tying means at said second tying station for sequentially moving bands through said second gap in said track means and tying the bands around loose stacks of signatures at said second tying station.

2. An apparatus as set forth in claim 1 wherein said shuttle means includes first pusher means for pushing a first stack of signatures and second pusher means for pushing a second stack of signatures, said drive means being operable to decrease the distance between said first and second pusher means to compress the first stack of signatures while the first stack of signatures is being moved by said first pusher means.

3. An apparatus as set forth in claim 1 further including support surface means for supporting stacks of signatures as they are moved by said shuttle means, and paper feed means for sequentially feeding sheets of paper through an opening in said support surface means into the path of movement of a stack of signatures along said support surface means, said shuttle means being operable to move a lower portion of one of the stacks of signatures into engagement with one of the sheets of paper and to move the one sheet of paper along said support surface means with the one stack of signatures under the influence of forces transmitted from said shuttle means to the one sheet of paper by the one stack of signatures.

4. An apparatus as set forth in claim 1 wherein said shuttle means includes a pusher arm having first side surface means for engaging a loose stack of signatures adjacent to the first side of said central station and for pushing the loose stack of signatures toward said second tying station and second side surface means for engaging a loose stack of signatures adjacent to the second side of said central station and for pushing the loose stack of signatures toward said first tying station, said drive means being operable to initiate movement of said pusher arm to push a loose stack of signatures toward said second tying station with said first and second side surface means adjacent to the first side of said central station, said drive means being operable to initiate movement of said pusher arm to push a loose stack of signatures toward said first tying station with said first and second surface means adjacent to the second side of said central station.

5. An apparatus as set forth in claim 1 wherein said shuttle assembly includes a plurality of base sections which are movable along said track means and a plurality of pusher arms each of which is connected with one of said base sections, said drive means including a plurality of motor means each of which is connected with one of said base sections, a first one of said motor means being operable to reciprocate a first one of said base sections and a first one of said pusher arms along said track means between said first and second gaps to sequentially push loose stacks of signatures toward said first and second tying stations, a second one of said motor means being operable to reciprocate a second one of said base sections and a second one of said pusher arms along said track means to sequentially push tied stacks of signatures from said first tying station toward said first receiving station, said second pusher arm being movable between opposite sides of said first gap during reciprocation of said second base section by said second motor means, a third one of said motor means being operable to reciprocate a third one of said base sections and a third one of said pusher arms along said track means to sequentially push tied stacks of signatures from said second tying station toward said second receiving station, said third pusher arm being movable between opposite sides of said second gap during reciprocation of said third base section by said third motor means.

6. An apparatus as set forth in claim 5 wherein said first pusher arm is fixedly connected with said first base section, said second and third pusher arms being movably connected with said second and third base sections, said shuttle means including a first pusher arm motor for moving said second pusher arm between an extended condition in which said second pusher arm is engageable with a tied stack of signatures and a retracted condition in which said second pusher arm is ineffective to engage a tied stack of signatures, said shuttle means including a second pusher arm motor for moving said third pusher arm between an extended condition in which said third pusher arm is engageable with a tied stack of signatures and a retracted condition in which said third pusher arm is ineffective to engage a tied stack of signatures.

7. An apparatus as set forth in claim 1 wherein said shuttle means includes a pusher arm having first surface means for pushing a loose stack of signatures toward said first tying station during each stroke of said shuttle means in a first direction as said shuttle means is reciprocated by said drive means and second surface means for pushing a loose stack of signatures toward said second tying station during each stroke of said shuttle means in a second direction as said shuttle means is reciprocated by said drive means.

8. An apparatus for sequentially tying loose stacks of signatures, said apparatus comprising a central station, a first tying station disposed adjacent to a first side of said central station, a second tying station disposed adjacent to a second side of said central station, a first receiving station disposed adjacent to a side of said first tying station opposite from said central station, a second receiving station disposed adjacent to a side of said second tying station opposite from said central station, a plurality of spaced apart pusher arms engageable with stacks of signatures, motor means for reciprocating said pusher arms to sequentially push loose stacks of signatures from said central station to said tying stations and to sequentially push tied stacks of signatures from said tying stations to said receiving stations, and control means for effecting operation of said motor means to decrease the distance between pusher arms disposed on opposite sides of loose stacks of signatures as the loose stacks of signatures move toward said first and second tying stations to compress the loose stacks of signatures during their movement toward said first and second tying stations.

9. An apparatus as set forth in claim 8 further including first support surface means for supporting loose stacks of signatures as they move toward said first tying station, second support surface means for supporting loose stacks of signatures as they move toward said second tying station, first paper feed means for sequentially feeding sheets of paper part way through an opening in said first support surface means, second paper feed means for sequentially feeding sheets of paper part way through an opening in said second support surface means, said pusher arms being operable to move a lower portion of a first loose stack of signatures into engagement with a first sheet of paper extending part way through the opening in said first support surface means and to continue the movement of the first loose stack of signatures along said first support surface means to pull the first sheet of paper from the opening in said first support surface means, said pusher arms being operable to move a lower portion of a second loose stack of signatures into engagement with a second sheet of paper extending part way through the opening in said second support surface means and to continue the movement of the second loose stack of signatures along said second support surface means to pull the second sheet of paper from the opening in said second support surface means.

10. An apparatus as set forth in claim 9 further including first tying means at said first tying station for tying bands around loose stacks of signatures with sheets of paper from said first paper feed means between the bottoms of the stacks and the bands, and second tying means at said second tying station for tying bands around loose stacks of signatures with sheets of paper from said second paper feed means between the bottoms of the stacks and the bands.

11. An apparatus as set forth in claim 10 further including track means extending from said first receiving station through said first tying station, central station and second tying station to said second receiving station, said track means including first surface means for defining a first gap in said track means at said first tying station and second surface means for defining a second gap in said track means at said second tying station, drive means for moving said pusher arms along said track means, said first tying means including means for moving bands through said first gap, said second tying means including means for moving bands through said second gap.

12. An apparatus for sequentially tying loose stacks of signatures, said apparatus comprising a central station, first and second tying stations disposed on opposite sides of said central station, a first paper feed station disposed between said central station and first tying station, first support surface means extending from said first paper feed station to said first tying station for supporting loose stacks of signatures, first paper feed means for sequentially positioning sheets of paper with their end portions extending upwardly of said first support surface means, a second paper feed station disposed between said central station and second tying station, second support surface means extending from said second paper feed station to said second tying station for supporting loose stacks of signatures, second paper feed means for sequentially positioning sheets of paper with their end portions extending upwardly of said second support surface means, shuttle means for sequentially pulling sheets of paper onto said first support surface means between bottoms of loose stacks of signatures and said first support surface means by sequentially moving leading end portions of loose stacks of signatures into engagement with projecting end portions of sheets of paper at said first paper feed station and then continuing the movement of the loose stacks of signatures along said first support surface means to said first tying station with each sheet of paper disposed between the bottoms of a loose stack of signatures and said first support surface means, first tying means at said first tying station for sequentially tying bands around loose stacks of signatures with sheets of paper disposed between the bottoms of the loose stacks of signatures and the bands, said shuttle means including means for sequentially pulling sheets of paper onto said second support surface means between bottoms of loose stacks of signatures and said second support surface means by sequentially moving leading end portions of loose stacks of signatures into engagement with projecting end portions of sheets of paper at said second paper feed station and then continuing the movement of the loose stacks of signatures along said second support surface means to said second tying station with each sheet of paper disposed between the bottom of a loose stack of signatures and said second support surface means, said second tying means at said second tying station for sequentially tying bands around loose stacks of signatures with sheets of paper disposed between the bottoms of the loose stacks of signatures and the bands.

13. An apparatus as set forth in claim 12 further including track means extending from said first tying station through said first paper feed station, central station and said second paper feed station to said second tying station, said track means including first surface means for defining a first gap in said track means at said first tying station and second surface means for defining a second gap in said track means at said second tying station, and drive means for reciprocating said shuttle means along said track means, said first tying means including means for sequentially moving bands through said first gap in said track means, said second tying means including means for moving bands through said second gap in said track means.

14. An apparatus as set forth in claim 12 wherein said first paper feed means includes means for supporting a roll of paper, means for feeding predetermined lengths of paper from the roll, and knife means for cutting the paper fed from the roll into predetermined lengths.

15. An apparatus for sequentially tying loose stacks of signatures, said apparatus comprising a tying station, means for sequentially moving the loose stacks of signatures toward said tying station, support surface means for supporting the stacks of signatures as they are moved by said moving means, feed means for sequentially feeding sheets of material through an opening in said support surface means into the path of movement of the stacks of signatures along said support surface means, said moving means being operable to move the leading portion of a stack of signatures into engagement with a sheet of material projecting through said opening to pull the sheet of material onto said support surface means and to move the sheet of material along said support surface means with the stack of signatures under the influence of forces transmitted from said moving means to the sheet of material by the stack of signatures, and tying means at said tying station for tying a band around the stack of signatures with the sheet of material being disposed between the bottom of the stack of signatures and the band.

* * * * *